United States Patent [19]

Mangla

[11] Patent Number: 4,625,905

[45] Date of Patent: Dec. 2, 1986

[54] HINGED COVER CARTON

[75] Inventor: Raj K. Mangla, East Rochester, N.Y.

[73] Assignee: Mobil Oil Corporation, New York, N.Y.

[21] Appl. No.: 831,088

[22] Filed: Feb. 20, 1986

Related U.S. Application Data

[63] Continuation of Ser. No. 630,164, Jul. 12, 1984, abandoned, and a continuation-in-part of Ser. No. 481,512, Apr. 1, 1983, abandoned.

[51] Int. Cl.[4] ..... B65D 1/24

[52] U.S. Cl. ..... 229/2.5 EC; 229/45 EC

[58] Field of Search ..... 229/2.5 EC, 45, 45 EC

[56] References Cited

U.S. PATENT DOCUMENTS

| | | | |
|---|---|---|---|
| 2,990,094 | 6/1961 | Reifers . | |
| 3,215,327 | 11/1965 | Crabtree . | |
| 3,337,110 | 8/1967 | Commisso . | |
| 3,356,284 | 12/1967 | Lake . | |
| 3,563,446 | 2/1971 | Lake . | |
| 3,568,916 | 3/1971 | Scheuring . | |
| 3,648,916 | 3/1972 | Commisso . | |
| 3,661,320 | 5/1972 | Donadson | 229/2.5 EC |
| 3,672,560 | 6/1972 | Voorhis . | |
| 3,672,693 | 6/1972 | Weir | 229/2.5 EC |
| 3,687,350 | 8/1972 | Warburton . | |
| 3,735,917 | 5/1973 | Warburton . | |
| 3,817,441 | 6/1974 | Jackson . | |
| 3,908,891 | 9/1975 | Jackson . | |
| 4,240,575 | 12/1980 | Tange | 229/2.5 EC |
| 4,295,597 | 10/1981 | Petersen | 229/2.5 EC |
| 4,382,536 | 5/1983 | Congleton | 229/2.5 EC |
| 4,383,638 | 5/1983 | Bixler | 229/2.5 EC |
| 4,419,068 | 12/1983 | Congleton | 229/2.5 EC |
| 4,492,331 | 1/1985 | Bixler et al. | 229/2.5 EC |

*Primary Examiner*—Joseph Man-Fu Moy
*Attorney, Agent, or Firm*—Alexander J. McKillop; Michael G. Gilman; Charles J. Speciale

[57] ABSTRACT

A carton with a hinged cover formed from plastic sheet material has a locking device which comprises a continuous, rigid locking member formed integrally with the bottom section of the carton which extends upwards from the bottom section with a forward-facing extension on the top for engaging with corresponding locking apertures formed in the cover. The cartons are particularly useful for packaging eggs since they permit eighteen-cell carton to be packed on conventional packaging equipment normally used for twelve-cell cartons.

34 Claims, 4 Drawing Figures

HINGED COVER CARTON

CROSS REFERENCE TO RELATED APPLICATIONS

This is a continuation of application Ser. No. 630,164, filed on July 12, 1984, now abandoned and a continuation in part of my co-pending U.S. patent application, Ser. No. 481,512, filed Apr. 1, 1983, which describes an egg carton having an extended cover which latches onto an extension of the egg-containing section, now abandoned.

My co-pending U.S. patent application, Ser. No. 630,163, filed concurrently with this application, describes the method of forming the locking slots or apertures used in the present cartons, now U.S. Pat. No. 4,012,153.

My co-pending U.S. Design patent application, Ser. No. 630,166, filed concurrently with this application, shows an ornamental design for a carton incorporating a locking device of the type described in the present application.

BACKGROUND OF THE INVENTION

This invention relates to cartons with hinged covers which are formed from sheets of plastic materials by a thermoforming process. The invention is particularly applicable to egg cartons but may be applied to other types of cartons also, especially those which are used to carry fragile articles in separate packaging cells within the carton.

Egg cartons used in the retail marketing of eggs have, up to the present, usually contained one dozen eggs packaged in two rows of six eggs each. These cartons, which may be made of wood pulp or, more recently, of thermoformed plastic, generally comprise a bottom section containing the egg-receiving cells, a cover which is generally in the form of an inverted dish-like lid and a locking flap which engages with the cover to hold it closed. Various locking devices have been previously described or used: U.S. Pat. Nos. 3,337,110 and 3,356,284, for example, describe cartons which have a locking flap on the bottom section with a locking detent which engages with a locking flange on the cover. U.S. Pat. No. 3,648,916 describes a carton with a latching flap on the bottom section which has wedge-shaped recesses matching similar recesses on the cover; latching bars on the recesses engage detent on the cover to provide the desired locking. Similar locking devices are shown in U.S. Pat. Nos. 3,687,350; 3,735,917, 3,817,441 and 3,908,891.

In some markets, eggs are sold in cartons of eighteen eggs, rather than in the traditional carton of one dozen. In the past, eighteen cell egg cartons have been thermoformed from plastic sheet only in versions which do not have complete protective covers although an eighteen cell carton with a protective cover has been produced in molded pulp. It would be desirable to be able to make an eighteen cell egg carton with an integral protective cover but the existing covered eighteen cell cartons such as the pulp carton presently on the market, cannot be thermoformed from plastic sheet. One reason for that is that the latch on the pulp carton has long elements, which, if thermoformed, would require a small, relatively narrow piece of the plastic sheet to be drawn a long way beyond the sheet line. In thermoforming, long extensions beyond the sheet line are generally undesirable because they produce considerable weakening.

On the other hand, it is not practicable to enlarge thermoformed plastic cartons of existing types by the inclusion of a third row of six egg cells, to form an eighteen egg carton because the enlarged cartons could not be accommodated on existing packaging equipment, a large amount of which is in use. Conventional packaging equipment is capable of accepting either covered twelve cell cartons with conventional locking flaps or the eighteen cell covered pulp cartons, both of which are small enough to fit within the equipment. If the twelve cell thermoformed plastic cartons were enlarged to hold eighteen eggs, the carton in the open position would exceed the maximum acceptable dimensions of 30×30 cm (12×12 inches). The covered pulp carton mentioned above can be used on conventional equipment because its locking elements extend upwards from the lower section of the carton rather than sideways, as the locking flap does on the conventional plastic cartons.

In my prior patent application, Ser. No. 481,512, I have described a thermoformed plastic carton which is capable of holding eighteen eggs while still being capable of being filled on conventional packaging equipment. The carton described in that application has latch elements which are formed on both the cover and cell sections by extending the plastic sheet beyond the sheet line during the thermoforming operation. In this way, the severe stretching of the plastic which would lead to weakening of the latch elements is avoided. The cover section on that carton extends down a considerable way and difficulties have occasionally occurred when the edge of the extended cover has caught on something and been forced open. It would be possible to reduce this risk by making the cover extension shallower but if this were done, the latching apertures would be brought too near the bottom edge of the cover, weakening the latching arrangement severely.

I have now devised a stackable carton which can be moulded by thermoforming a plastic sheet and which has an improved locking device. The locking device can be used on divers types of carton but is especially useful with egg cartons because it enables covered eighteen cell egg cartons, which are capable of being packaged on conventional equipment, to be made from plastic sheet by thermoforming. The locking device is, moreover, sturdy and capable of providing a firm locking engagement between the cover and the cell section.

SUMMARY OF THE INVENTION

According to my invention, the carton, which is moulded from a plastic sheet by thermoforming comprises a bottom section for receiving the articles to be packaged and a cover which has an inverted dishlike configuration with front, rear and side walls. The rear wall is resiliently hinged to the rear edge of the bottom section, suitably by a single or double hinge line. An integral, continuous locking member extends upwardly in a fixed position from the front edge of the bottom section and has a number of locking extensions at the top which extend towards the inside of the front wall of the cover when the cover is in the closed position. The locking extensions engage with a number of locking slots which are formed in locking recesses in the front wall of the cover in order to provide the desired locking effect when the cover is closed. The integral locking member is sufficiently rigid that it remains in a fixed portion relative to the bottom section; however, the plastic sheet material of which the carton is formed permits a certain amount of deformation in the locking member and the cover that, when the carton is to be opened, the locking bar can be disengaged from the locking slots in the cover by moving the front wall of the cover and the locking member away from one another.

The locking device is particularly useful with egg cartons because it enables eighteen cell plastic cartons to be made which can be used on existing packaging equipment, as its dimensions when open do not exceed the permissible 30×30 cm. The cartons can therefore be stacked in the required manner on the equipment. However, the locking mechanism may also be used to advantage on the more conventional twelve-cell cartons. When the locking device is used on an egg carton, the bottom section comprises the egg-receiving cells, and these are conveniently dimensioned so that the eggs are enclosed for rather less than their vertical dimension in order to permit easy removal; the cover section is dimensioned so that the eggs are accommodated snugly within the carton.

The cellular configuration of the bottom section of the egg carton contributes materially to the rigidity of the integral locking member by providing a buttressed configuration in which curvilinear buttresses extend down from the locking member to the divisions between the cells.

The carton is suitably made by thermoforming a plastic sheet, for example, foamed polystyrene, into the desired configuration. During the forming operation, the male and female mould members are closed on a preheated sheet of plastic and the bottom section and the cover are formed by drawing the plastic into the mould in one direction from the sheet line. The integral locking member, however, is formed by drawing the sheet in the opposite direction from the sheet line. The locking slots in the recesses in the cover are formed during the moulding operation using a suitable die.

DRAWINGS

FIG. 5 is a front view of a portion of the carton showing the locking device;

FIG. 6 is a section along 6—6' of FIG. 4;

FIG. 7 is a section along 7—7' of FIG. 4;

FIG. 8 is a section along 8—8' of FIG. 4;

FIG. 9 is a section of the carton along 6—6' of FIG. 4 but with the carton in the partly closed position;

FIGS. 10A, 10B and 10C are simplified diagrammatic representations of the thermoforming process used to make the carton;

FIG. 11A is a fragmentary isometric view of the male die used in the thermoforming process;

FIG. 11B is a fragmentary isometric view of the female die used in the thermoforming process;

FIG. 11C is an enlarged view of part of FIG. 11;

FIG. 12 is a vertical view, partly in section of a portion the male die in the direction shown by arrow A in FIG. 11A;

FIG. 13 is a cross section of the male and female dies in operation, along the line indicated by 13—13' in FIG. 12;

FIG. 14 is an enlarged isometric view of the male shear key used in the male die.

DETAILED DESCRIPTION

Prior Cartons

Figure 1:
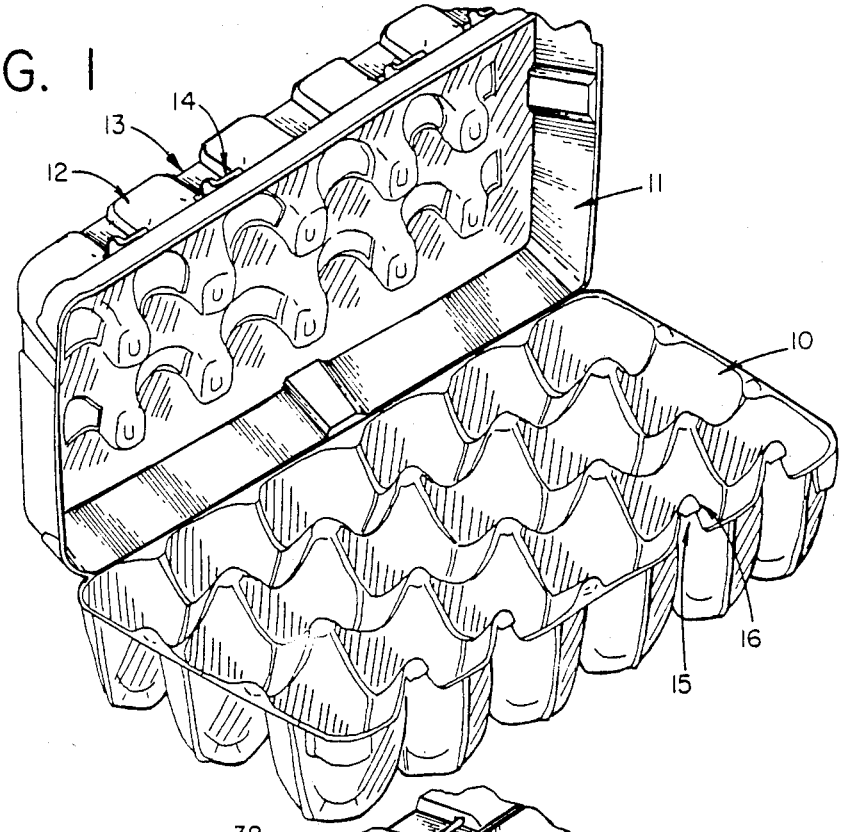
FIG. 1 is an isometric view of a known type of eighteen-cell pulp egg carton.

A known type of eighteen-cell moulded wood pulp carton is shown in FIG. 1. It has a bottom section 10 for holding the eggs in a conventional 6×3 arrangement. The cover 11 is formed integrally with the bottom section at the rear of the cover. The front wall 12 of cover 11 has four roughly-formed indentations 13 with a locking aperture 14 formed in each of them, of an approximately inverted-T configuration (only one is designated for clarity). Four corresponding locking projections 15 stand up from the front of the bottom section with the top of each locking projection being formed into a hook-like latch 16 which engages with the locking edge of each locking aperture 14 when the cover is in the closed position.

Pulp cartons of this kind may be used in conventional packaging equipment because they do not exceed the permissible 30×30 cm size (plan view) when open. However, if attempts were made to fabricate these cartons from plastic sheet by thermoforming, the severe drawing of relatively narrow pieces of the plastic sheet which would be necessary to produce the latching projections 15 would lead to grossly weakened regions around the areas where the drawing occurs, mostly in the projections themselves.

Present Carton

Figure 2:
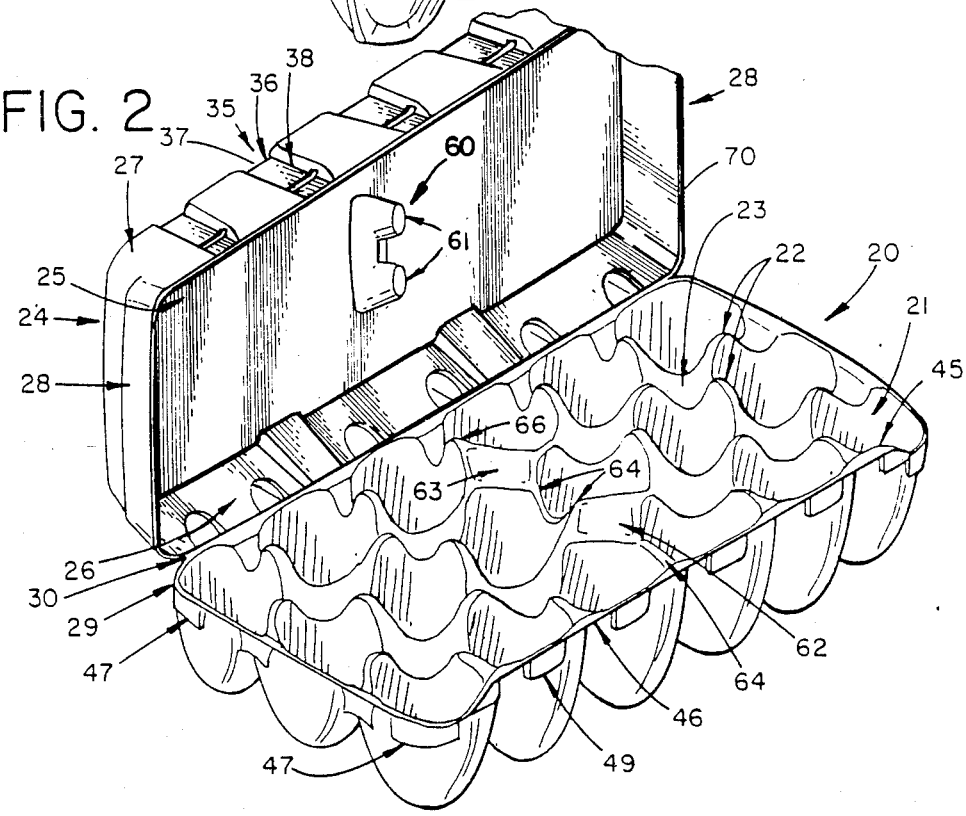
FIG. 2 is an isometric view of an eighteen-cell plastic egg carton having the improved locking device.
Figure 3:
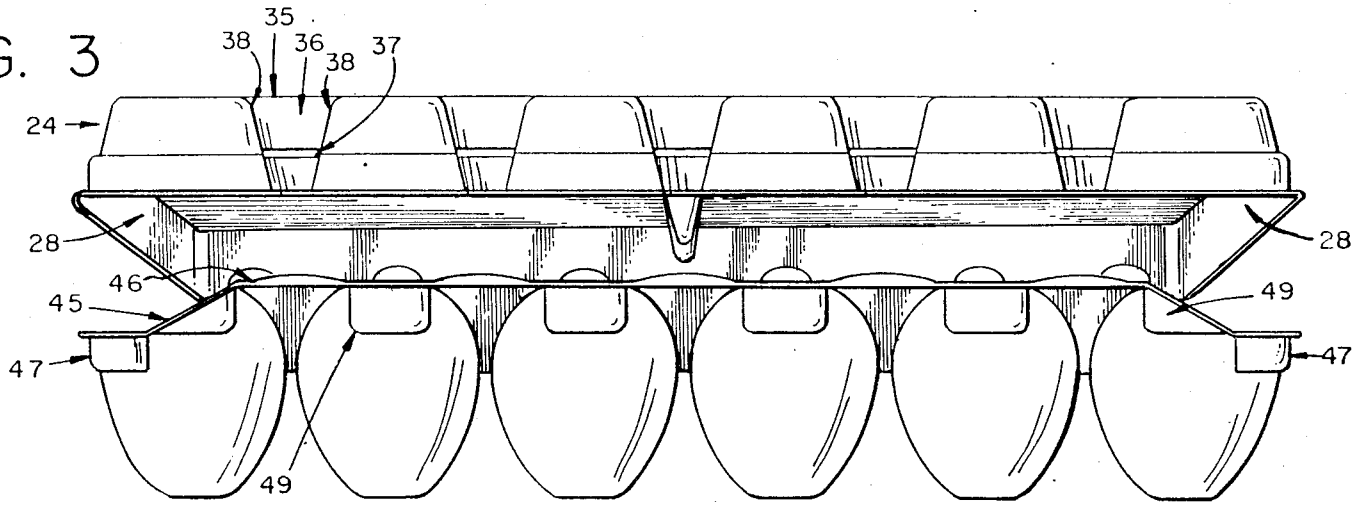
FIG. 3 is a front view of the carton of FIG. 2 in the partly open position.
Figure 4:
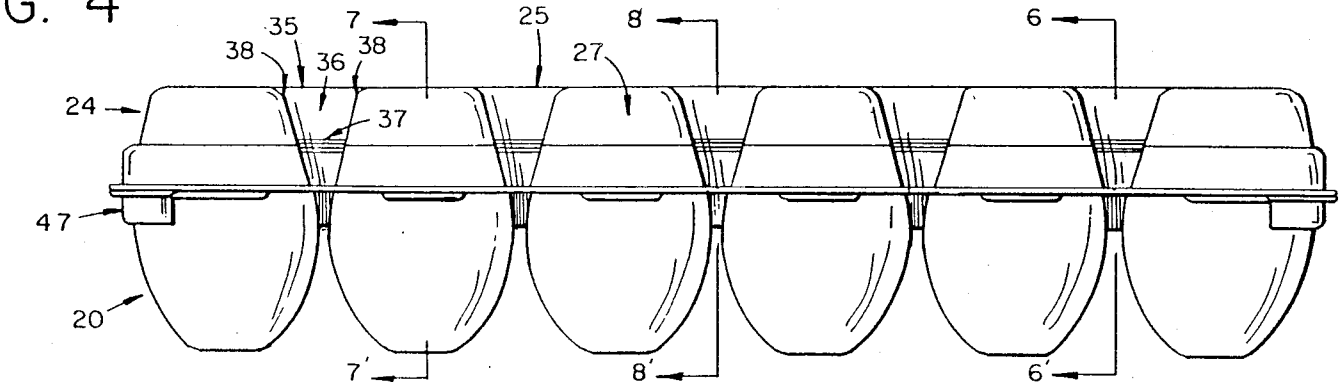
FIG. 4 is a front view of the carton of FIG. 2 in the fully closed position.

The plastic carton including the locking device according to the present invention, overcomes these disadvantages. An eighteen-cell egg carton with such a locking device is shown generally in FIG. 2 of the drawings and includes a bottom section 20 with the egg receiving cells 21 (only one is designated) arranged conventionally in three rows of six cells each. In order to provide a high degree of protection for the eggs, projecting tips 22 are provided (only two are designated in FIG. 2) between adjacent cells, both transversely and longitudinally; however, at the center of the carton (see FIG. 8), the tips are omitted for a purpose which will be explained below. The use of projecting tips between the egg cells to provide additional protection for the eggs is described in U.S. Pat. Nos. 3,563,446, 3,687,350, 3,817,441 and 3,908,891, to which reference is made for details of various arrangements for these tips, including tips extending in a ridge-like form between two pairs of cells, either in a longitudinal or transverse direction. Any of these arrangements may be used in the present cartons but in the carton shown in the drawings, individual tips are provided between each pair of cells, both transversely and longitudinally, except at the center of the carton. Between each group of four tips, a depressed region 23 is provided to permit easy removal of the eggs. However, a different arrangement is used at the center of the carton, as described below.

The cover 24 is of inverted dish-like configuration and has a generally flat top 25, a rear wall 26, a front wall 27 and side walls 28. The cover is integrally formed with bottom section 20 and is attached by rear wall 26 to the rear edge 29 of bottom section 20 by a resilient hinge 30 suitably of single or double fold configuration. Front wall 27 of the cover has a number of locking flutes or recesses 35 which are of wedge-shaped (trapezoidal) configuration although they may also be parallel-sided or even of curvilinear configuration, if desired. Trapezoidal and curvilinear flute configurations having narrower widths at the bottom of the front wall are preferred because they will help to align the cover on the bottom section as the carton is closed. In this case, there is a locking flute situated on the center line extending between each pair of transverse, short (three cell) rows of egg cells, so that there is a total of five locking flutes, only one of which is designated for clarity. However, the number may be varied; for example, two or three symmetrically disposed flutes may be used although, naturally, to do so would not provide so much security as the five shown.

The rear face 36 of each locking flute 35 is offset inwardly from the remainder of the inner face of front wall 27 and a locking aperture 37, here of slot-like configuration, is provided in each flute, extending along the rear face and into the two side walls 38 of each flute 35. The locking aperture is formed in the manner described below with a flat edge 39 on its lower margin, preferably with a clean, sharp edge on the inside in order to provide firm, positive locking. The offset of each locking flute 35 increases from the bottom up to the locking aperture; i.e., in the direction from the edge of cover 24 towards aperture 37 so that as the cover is closed onto the bottom section, the sloping inner surfaces 40 of the locking recesses (see FIGS. 6 and 9) slide easily over the locking member on the bottom section until engagement occurs between the locking surfaces. From the locking aperture up to the top 25 of the cover, the flute is of constant offset.

At the front of bottom section 20 a rigid, integral member 45 is formed by a fixed, upward extension of the egg cells and the region between them. The locking member has five locking extensions 46 (one designated) which extend forwards toward the inner face of front wall 27 of cover 24 when the cover is in the closed position (see FIG. 6). These locking extensions, one for each locking flute, are formed by a forward extension of the plastic sheet in the region between each two short rows of egg cells; because the curving wall of each egg cell is close to the edge of the carton, there is no forward extension of the sheet along the center line of each short row of cells but, in principle, there is no reason why it should not be provided there to provide a continuous locking extension along the entire top edge of locking member 45, except that it would enlarge the carton size, possibly beyond the desired 30 cm in the open position.

Rectangular stacking lugs 49 are provided on locking member 45 between the locking extensions (only partial on the two end cells) to prevent the cartons from becoming jammed together when they are stacked for shipping. Corner stacking lugs 47 are also provided on the corners of the carton for a similar purpose. Stacking lugs 49 on locking member 45, however, help to maintain the desired rigidity in locking member 45. If desired, stacking lugs 49 could be extended laterally so that they extend around the curve of the egg cells to provide ever greater rigidity and possibly also to provide a greater degree of self-aligning for the locking flutes as the carton is closed. The locking member also derives additional support from the buttress-like configuration of the sloping wall 48 of the locking member where it extends down from locking extensions 46 and into the bottom section 20 between the short rows of cells (see FIGS. 6 and 8). If a section along the locking member just above the sheet line is taken, it will be seen that the locking member has an undulating configuration with portions which extend inwardly between adjacent egg cells in the front row that is, between adjacent transverse rows of cells, to provide rigidity to the locking member. The inwardly extending portions provide ribs which confer lateral strength to the locking member and maintain it in its fixed position. At the bottom of their extent, these ribs merge into the protective tips between the egg cells in the front longitudinal row—except at the center of this row where there is a depression between the cells, as discussed further below.

As can be seen in FIG. 9, the desired locking engagement between integral locking member 45 and locking flutes 35 is obtained as the carton is closed. The sloping inner surfaces 40 of the locking recesses slide over locking extensions 46 until locking slots 37 come into line with locking extensions 46, the necessary lateral movement of the locking parts being provided by the resilient nature of the plastic material. When locking slots 37 come into line with locking extensions 46, the locking extensions snap into the slots, securing the cover to the bottom section (FIG. 6). When the carton is to be opened, the locking parts can be separated by running a digital extremity under the edge of front wall 27 of the cover so as to move the front wall of the cover and locking member 45 relatively away from one another so that locking extensions 46 are drawn out of locking slots 37, until the cover can be opened upwards in the normal way. When the carton is fully closed, the outer edges of the locking extensions remain within the locking flutes so that inadvertent release of the locking parts is unlikely.

If the number of locking flutes is reduced, for example, to two or three symmetrically disposed ones, it is desirable to omit either the flutes or the locking extensions 46 in the regions between the short cell rows where there are no locking parts, otherwise the cover will be distorted when it is closed. However, it is preferred that the inner face of the front wall of the cover should be in contact with the locking member along the entire length between the locking parts and so, it will be preferred either to omit the flutes or the locking extensions (but not both) in the areas where there are no locking parts. However, if unslotted flutes are provided for reasons of rigidity or appearance, locking extensions 46 may be omitted in the region facing these unslotted flutes.

It may be desirable to have shorter locking extensions 46 at the two outer ends of the carton because the flexing of the carton sometimes prevents the locking extensions in these positions from sliding all the way up the locking recesses and into engagement with the locking slots. However, if the extensions at these positions are trimmed back slightly, these extensions will slide readily up the flutes and then into the locking slots.

In order to provide support for cover 24 a dependent support post 60 is formed in the cover. This support post has two feet 61 which, when the carton is closed, rest on two large, flat-topped protruding support tips 62, 63 along the transverse center line of the carton between adjacent egg cells. An alternative arrangement would be to have a ridge-like foot at the bottom of post 60 which would rest on a corresponding ridge-like protrusion along the transverse center line of the carton, similar to that shown in U.S. Pat. Nos. 3,563,446 (FIGS. 5 and 6) and 3,817,441 to which reference is made for details of such cover support arrangements. However, this alternative arrangement would be less desirable than the one shown, for reasons explained below.

It has been found that although the provision of the projecting tips 22 between adjacent egg cells is desirable for the purpose of protecting the eggs, this does tend to make the carton more flexible than is desirable: the carton has less resistance to sagging in the center when supported at the ends or to sagging at the ends when supported in the center. This undesired flexure may, however, be overcome by providing vertical reinforcing elements in the carton between adjacent cells in the longitudinal rows. These vertically-extending, longitudinal elements, formed during the moulding process, contribute to the beam strength and rigidity of the carton and help prevent sagging. In the carton shown, the vertical beam elements are provided along the transverse center line of the carton; it has been found that this provides sufficient rigidity and resistance to flexure. These vertically-extending, longitudinal elements are provided by shoulders 64 which extend down from support tips 62, 63 to depressed regions 65 between adjacent cells in the longitudinal (six cell) rows at the transverse center line of the carton. Because the vertical parts of the rear wall of the carton together with the attached cover provide considerable resistance to sagging of either kind at the rear of the carton, it is unnecessary to provide a depression between the cells in the rear longitudinal row and, accordingly, the support tip 62 between the two rear longitudinal rows has an extending shoulder 66 between the middle two egg cells in that row to provide cushioning for the eggs in those cells. Similarly, the upwardly-extending locking member provides additional rigidity at the front of the carton but in order to confer sufficient total resistance to flexure, the reinforcing vertically-extending elements at the front of the carton are provided by the depressed region 65 in the front row of cells, as shown.

Rear wall 26 of cover 24 has a number of depressions 70 (one designated) of approximately parabolic configuration which extend outwardly from the general plane of the inner face of this wall. The purpose of these depressions is to provide additional clearance for the eggs in the rear longitudinal row of cells when the carton is closed. It has been found that, in some instances, when these depressions are not provided, the rear wall of the carton presses against the eggs in the rear row of cells when the carton is being closed, particularly with the larger egg sizes. This may move the cover back just far enough to prevent it closing easily over the locking member. The provision of the generally parabolic depressions, however, provides additional clearance when the carton is being closed while, at the same time, holding the eggs in place once the carton is fully closed. Accordingly, there is one depression 70 in rear wall 26 aligned with each cell in the rear longitudinal row of cells so as to provide clearance for each egg in the row. Generally, the inner face of the depression should be offset outwards by about 0.5 to 1 mm from the general plane of the inner face of the wall. The parabolic configuration for the depressions is preferred because it holds the eggs in place firmly when the carton is fully closed as the top margin of the depression fits snugly around the egg when the cover is closed. However, other curvilinear or rectilinear depressions may be used, if desired, although to possibly less advantage.

Carton Manufacture

The cartons are made by thermoforming a sheet plastic resin material into the requisite shape. The preferred plastic resin material for making egg cartons is foamed polystyrene because it is cheap and has satisfactory mechanical properties: it has adequate stiffness, provides satisfactory protection for the eggs and can be readily printed. However, other plastic resin materials could be used, depending upon the type of articles to be packaged in the carton. The manufacture of the cartons will be described below by specific reference to the use of foamed polystyrene for making egg cartons but similar methods may be used with other sheet plastic resin materials with appropriate modification of process conditions; e.g. sheet thickness, mould compression and pressure, temperature, mould cycle time and so forth.

In the thermoforming operation, a sheet of the plastic resin material is moulded between male and female dies or mould members into the desired configuration. The temperatures encountered during the moulding operation will tend to cause sheets of foamed polystyrene to expand but the mould configuration will control the thickness of the sheet in the various parts of the carton; some parts may be thinner than the initial sheet and others thicker.

The moulding cycle is shown in FIGS. 10A to 10C, in simplified form. A male die 90 can be closed on a female die 91 with the sheet of plastic resin material 92 between them. In practice, the mould members will have a number of carton moulding cavities arranged in them so that a number of cartons can be formed at each closing of the dies, but only one pair of carton moulding dies are shown in the drawings, for clarity.

As the dies close, as shown in FIG. 10B, the plastic sheet is drawn down to stretch the plastic over the die members until, when the dies are completely closed, as shown in FIG. 10C, the sheet is formed into the desired configuration between the male and female dies. At the same time as the sheet is shaped, the locking slots are formed in the manner described in detail below.

In order to form locking member 45, the male and female dies are shaped so as to draw the sheet up from the sheet line in the opposite direction to that in which the bottom section and the cover are formed. To do this, a former 94 on the female die 91 which produces the front of the carton is extended upwards, and the edge of the male die correspondingly cut away to form cavity 95, so that when the dies are closed (FIG. 10C), the plastic sheet is drawn upwards to form the locking member, in the opposite direction to that in which the cover and bottom sections are drawn. As shown in FIG. 10C, the cover and the bottom section are drawn downwards from sheet line 96 and the locking member is drawn upwards from the sheet line. Locking extensions 46 on the locking member are formed by the outward extension of the sheet. Trimming of the thermoformed sheet following ejection from the mould provides the desired sharp edge to the locking extensions.

As previously mentioned, the locking slots 37 in the locking flutes are three-dimensional slots which extend along the rear face 36 of each locking flute and into its side walls 38. In order to provide firm locking engagement with locking extensions 46 on the locking member these locking slots should be as sharply edged and as well-defined as possible. It has been found that such slots can be made by shearing the plastic sheet during the thermoforming operation rather than going to the additional expense of a cutting operation subsequent to the thermoforming step.

A partial view of the male and female moulding dies is given in FIGS. 11A and 11B respectively, showing the die configurations in the areas where the locking flutes are formed. The male die has a configuration which conforms to the configuration desired for the inside of the carton. The portion of the male die used to form the inside of the locking flutes with their attendant locking slots is shown in FIG. 11A and FIG. 12 shows a vertical view of one of the depressions in the die which are used to form the recess and its slot. The corresponding female die forms the outside of the carton and FIG. 10B shows the part of the female die which mates with the part of the male die shown in FIG. 11A. The shearing action of the shear keys is shown in FIG. 13.

The inner moulding surface of male die 90 has a number of depressions in the surface used to form the rear face of the front wall of the cover. These depressions, 101, correspond in number to the number of locking flutes to be formed in the cover of the carton (only one is designated in FIG. 11A for clarity). Each depression has a rear wall 102 and side walls 103 which are joined to the rear wall by means of a curving fillet. The depression is both deeper and wider at its top end than its bottom (referring to the disposition of the die shown in FIG. 11A, although it should be remembered that in use the male die will be inverted from this position), in order to give the correct trapezoidal, wedge-shaped configuration to the locking flutes.

The male shear key 105 for forming the locking slot is situated a little more than halfway down depression 101, at the point where the locking slot is to be formed. Male shear key 105 (shown by itself in FIG. 14) has a rear shear face 106 and two lateral shear faces 107 which are inclined at an angle laterally to the rear shear face. Rear shear face 105 projects out from rear wall 102 of the depression in order to engage with the shear key on the female die to form the locking slot. The lateral shear faces on the male shear key are inclined at an angle (with respect to the rear face) which corresponds substantially to the angle of the side walls (with respect to the rear wall) of the locking flute and thus, the angle chosen will depend upon the configuration of the flute. If the flute is curvilinear in cross-section, e.g., arcuate, the male shear key may have a corresponding contour and the female shear key will have a like contour.

Male shear key 105 is retained in a slot-like channel 108 within the body of male die 90. It is held within the channel by means of an abutment 109 at its rear end which fits within a cavity 110 in the body of the die.

The shear key is pre-loaded by means of concavo-convex washers 111, although other suitable biasing means such as springs, resilient pads or pneumatic or hydraulic devices could be used. The simpler mechanical devices such as the washers shown or springs will normally be preferred for simplicity. The pre-load washers are held in by backplate 112 which is retained by means of screws 113.

The foremost faces 114 of the male shear key are chamfered to provide a ramp down which the leading corner of the female shear key may slide as the dies close For this purpose, a ramp angle, (FIG. 13) of from about 10° to 30°, preferably about 15° to 20°, will be suitable. For similar reasons, the shear faces of the shear key may be inclined at an angle to the direction of die movement although the angle in this case should be much less, preferably about 1°–4°, in order to promote good shearing action The corresponding female shear key 115 is fitted into female die 91 in flute-forming protrusion or ramp 116 which has a configuration conforming to that desired in the outer surface of the locking flutes. The female shear key may be positively fixed in female die 91 without providing for any movement as the male shear key will be capable of taking up any side play during the moulding cycle. However, a relief chamfer may be provided on the leading edge of the female shear key (see FIG. 13) in order to ease the shear faces over one another at the beginning of the shearing action and to prevent chipping of the keys at their leading edges.

As the plastic sheet is drawn into the mould by the movement of the dies, the mating die surfaces approach one another more closely until the shear faces of the male and female shear keys come into engagement with one another, just before the dies close completely The front shear face 117 of the female shear key then engages with rear shear face 106 of the male shear key and the lateral shear faces 118 (only one designated in FIG. 11B) with the lateral shear faces 107 of the male shear key. Further closing movement of the dies then shears the heat-softened plastic away from the shear faces of the shear keys, this process being assisted by the inherent tendency of the softened plastic to draw away from any puncture formed in it. The exact mating between the shear keys which is provided by their configuration and the pre-load on the male key ensures that a clean, sharp-edged locking slot is formed in the carton which gives the desired efficient locking characteristics.

The aperture forming process is described in greater detail in my co-pending patent application, Ser. No. 630,163, to which reference is made for further details of the process and for the dies which are used in it.

I claim:

1. A carton moulded from a sheet of plastic resin material by thermoforming and comprising:

(i) a bottom section having cells for receiving articles to be packaged, (ii) a cover formed integrally with the bottom section and having a top, a front wall, side walls and back wall which is resiliently hinged at its lower edge to the rear edge of the bottom section, (iii) the front wall of the cover having a plurality of inwardly extending locking flutes, (iv) each locking flute having a locking aperture formed in it, (v) the outermost wall of said cells extending upwardly and terminating at a top edge of said bottom section, the regions between at least some of said cells forming a recess with top of each recess being locking extensions corresponding to each locking aperture, each locking extension extending from the rear of a recess forwards to said top front edge, each locking extension engaging with the lower edge of the corresponding locking aperture when the cover is in the closed position.

2. A carton according to claim 1 in which each locking flute has a trapezoidal configuration, narrow at the bottom edge of the front wall of the cover, increasing in width towards the top of the cover.

3. A carton according to claim 1 in which each locking flute is inwardly offset from the front wall of the cover and of increasing depth from the bottom edge of the front wall of the cover up to the locking aperture.

4. A carton according to claim 2 in which each locking flute is inwardly offset from the front wall of the cover and of increasing depth from the bottom edge of the front wall of the cover up to the locking aperture.

5. A carton according to claim 1 in which each locking aperture extends from the rear of each flute to the rear face of the front wall of the cover.

6. A carton according to claim 4 in which each locking aperture extends from the rear of each flute to the rear face of the front wall of the cover.

7. A carton according to claim 5 in which each locking aperture has a slot-like configuration extending along the locking flute in which it is situated.

8. A carton according to claim 6 in which each locking aperture has a slot-like configuration extending along the locking flute in which it is situated.

9. A carton according to claim 1 in which a continuous rigid locking member having said locking extensions is formed by an upward extendions of the plastic sheet material from the sheet line during the thermoforming operation.

10. A carton according to claim 1 in which the locking apertures are aligned longitudinally to define an interrupted channel in which said locking extensions are received when the carton is closed.

11. A carton adapted for the packaging of eggs which is moulded from a sheet of plastic resin material by thermoforming, and comprising:

(i) a bottom section comprising a plurality of egg receiving cells, (ii) a cover formed integrally with the bottom section and having a top, a front wall, side walls and a back wall which is resiliently hinged as its lower edge to the rear edge of the bottom section, (iii) the front wall of the cover having a plurality of inwardly extending locking flutes, (iv) each locking flute having a rear face which is inwardly offset from the inner face of the front wall of the cover and having a locking aperture across the rear face of the flute and extending to the inner face of the flute and extending to the inner face of the front wall of the cover at both sides of the flute;

(v) the outermost wall of said cells extending upwardly and terminating at a top edge of said bottom section, the regions between at least some of said cells forming a recess with the top of each recess being locking extensions corresponding to each locking aperture, each locking extension extending from the rear of a recess forwards toward said top front edge, each locking extension engaging with the lower edge of the corresponding locking aperture when the cover is inthe the closed position.

12. A carton according to claim 11 in which each locking flute has a trapezoidal configuration, narrow at the bottom edge of the front wall of the cover, increasing in width towards the top of the cover.

13. A carton according to claim 11 in which each locking flute is inwardly offset from the front wall of the cover and of increasing depth from the bottom edge of the front wall of the cover up to the locking aperture.

14. A carton according to claim 12 in which each locking flute is inwardly offset from the front wall of the cover and of increasing depth from the bottom edge of the front wall of the cover up to the locking aperture.

15. A carton according to claim 11 in which each locking aperture has a slot-like configuration extending along the locking flute in which it is situated.

16. A carton according to claim 11 in which a continuous rigid locking member with said locking extensions is formed by an upward extension of the plastic sheet material from the sheet line during the thermoforming operation.

17. A carton according to claim 16 in which the continuous locking member has a straight, outwardly-facing edge at its top defining the ends of the locking extensions.

18. A carton according to claim 16 in which the locking member has ribs which extend downwardly from its top and inwardly between adjacent egg cells in the front longitudinal row of egg cells.

19. A carton according to claim 18 in which the ribs extend into protective tips between adjacent egg cells in the front longitudinal row of egg cells.

20. A carton according to claim 17 in which the continuous locking member extends downwards towards the regions between each pair of egg-receiving cells in a front longitudinal row of cells in a curvilinear configuration providing a buttress between each such pair of cells.

21. A carton according to claim 11 which includes protective, upwardly-projecting tips between adjacent egg-receiving cells.

22. A carton according to claim 11 in which the egg-receiving cells are arranged in a plurality of longitudinal and transverse rows and which includes protective, upwardly-projecting tips between adjacent egg-receiving cells in the rows.

23. A carton according to claim 11 in which the egg-receiving cells are arranged in a plurality of longitudinal and a plurality of transverse rows with an even number of transverse rows, the carton including protective, upwardly-projecting tips between adjacent egg-receiving cells except between longitudinally adjacent cells (other than the longitudinally adjacent cells in the rear longitudinal row) of the two central transverse rows.

24. A carton according to claim 23 in which a depressed region is provided between adjacent cells between which there are no protective tips, to provide vertically extending, longitudinal elements contributing to the rigidity of the carton.

25. A carton according to claim 22 which includes:

(i) a raised post disposed between each longitudinal row of cells and between each of the two central transverse rows of cells and, (ii) a cover support member extending downwards from the top of the cover and which rests upon the raised posts when the carton is closed.

26. A carton according to claim 25 in which the cover support member terminates in a downwardly extending foot corresponding to each raised post.

27. A carton according to claim 25 in which the egg receiving cells are arranged in three longitudinal rows of six cells each, with two raised posts disposed between the longitudinal rows and between each of the two central transverse rows of cells.

28. A carton according to claim 27 in which the cover support member has two feet which rest upon the posts when the carton is closed.

29. A carton according to claim 25 in which the raised post between the rear longitudinal row of cells and the adjacent longitudinal row has a shoulder extending between the pair of cells which is in the rear longitudinal row and in the two central transverse rows.

30. A carton according to claim 25 in which each raised post has a shoulder extending between adjacent cells in the transverse rows between which the raised post is situated.

31. A carton according to claim 22 which includes a depressed region between each group of four cells separated by the projecting tips.

32. A carton according to claim 11 in which the rear wall of the cover is depressed on its inner face to form a depression aligned with each transverse row of egg cells inthe carton to provide additional clearance between eggs in the rear longitudinal row of cells and the cover as the carbon is closed.

33. A carton according to claim 32, in which the depressions are of parabolic configuration.

34. A carton according to claim 11 formed of foamed polystyrene resin.

* * * * *